US006588485B1

(12) United States Patent
Decker

(10) Patent No.: US 6,588,485 B1
(45) Date of Patent: Jul. 8, 2003

(54) HYBRID METHOD FOR MANUFACTURING TITANIUM COMPRESSOR WHEEL

(75) Inventor: David Michael Decker, Arden, NC (US)

(73) Assignee: BorgWarner, Inc., Auburn Hills, MI (US)

( * ) Notice: Subject to any disclaimer, the term of this patent is extended or adjusted under 35 U.S.C. 154(b) by 0 days.

(21) Appl. No.: 10/143,150

(22) Filed: May 10, 2002

(51) Int. Cl.[7] ..... B22D 17/00; B22D 33/04; B22C 9/04

(52) U.S. Cl. ..... 164/35; 164/45; 164/113; 164/137

(58) Field of Search ..... 164/113, 119, 164/303–318, 35, 45, 137, 342

(56) References Cited

U.S. PATENT DOCUMENTS 4,975,041 A * 12/1990 Fries et al. ..... 425/547

FOREIGN PATENT DOCUMENTS

JP 63-171242 * 7/1988

* cited by examiner

*Primary Examiner*—Kuang Y. Lin
(74) *Attorney, Agent, or Firm*—Pendorf & Cutliff; Greg Dziegielewski

(57) ABSTRACT

Cost considerations have prevented the use of titanium compressor wheels (1) in automotive air boost devices. A hybrid process is disclosed, wherein a wax pattern used in the investment casting process is intentionally designed not to produce a final (net shape) compressor wheel, but rather, is designed to produce a near net shape pattern including filled in areas (10, 11) which must be subsequently machined or milled away to produce the desired non-pullable shape compressor wheel. Surprisingly, when forming a titanium compressor wheel using the hybrid or two-step process, the technical complexity of each step (pattern forming and machining) is substantially lower, distortion of the wax blades (4) during pattern casting is reduced, casting of titanium is simplified, the process allows itself to be fully automated, and the dimensional accuracy of the final product is greater than with conventional techniques.

17 Claims, 4 Drawing Sheets

HYBRID METHOD FOR MANUFACTURING TITANIUM COMPRESSOR WHEEL

FIELD OF THE INVENTION

Cost considerations have prevented the use of titanium compressor wheels in automotive air boost devices. The present invention concerns an economical process for the manufacture of titanium compressor wheels.

DESCRIPTION OF THE RELATED ART

Air boost devices (turbochargers, superchargers, electric compressors, etc.) are used to increase combustion air throughput and density, thereby increasing power and responsiveness of internal combustion engines.

The blades of a compressor wheel have a highly complex shape which is design-optimized for (a) drawing air in axially, (b) accelerating this air centrifugally, and (c) discharging air radially outward into the volute-shaped chamber of a compressor housing. In order to accomplish these three distinct functions with maximum efficiency, the blades can be said to have three separate regions.

First, the leading edge of the blade can be described as a sharp pitch helix, adapted for scooping air in and moving air axially. Considering only the leading edge of the blade, the cantilevered or outboard tip travels faster (MPS) than the part closest to the hub, and is generally provided with an even greater pitch angle than the part closest to the hub (see FIG. 1). Thus, the angle of attack of the leading edge of the blade undergoes a twist from lower pitch near the hub to a higher pitch at the outer tip of the leading edge. Further, the leading edge of the blade generally is bowed, and is not planar. Further yet, the leading edge of the blade generally has a "dip" near the hub and a "rise" or convexity along the outer third of the blade tip. These design features are all engineered to enhance the function of drawing air in axially.

Next, in the second or transitional region of the blades, the blades are curved in a manner to change the direction of the airflow from axial to radial, and at the same time to rapidly spin the air centrifugally and accelerate the air to a high velocity, so that when diffused in a volute chamber after leaving the impeller the energy is recovered in the form of increased pressure. Air is trapped in airflow channels defined between the blades, as well as between the inner wall of the compressor wheel housing and the radially enlarged disc-like portion of the hub which defines a floor space, the housing-to-floor spacing narrowing in the direction of air flow.

Finally, in the third region, the blades terminate in a trailing edge, which is designed for propelling air radially out of the compressor wheel. The design of this blade trailing edge is generally complex, provided with (a) a rake angle (angle of surface relative to center line), (b) an angle offset from radial, and/or a back taper or back sweep (which, together with the forward sweep at the leading edge, provides the blade with an overall "S" shape). Air expelled in this way has not only high flow, but permits recovery of high pressure over a wide flow range.

Accordingly, functional considerations dictate the complex shape of a compressor wheel.

Recently, tighter regulation of engine exhaust emissions has led to an interest in even higher pressure ratio boosting devices. Current aluminum compressor wheels are not capable of withstanding repeated exposure to higher pressure ratios (>3.8). While aluminum is a material of choice for compressor wheels due to low weight and low cost, the temperature at the blade tips, and the stresses due to increased centrifugal forces at high RPM, exceed the capability of conventionally employed aluminum alloys. Refinements have been made to aluminum compressor wheels, but due to the inherent limited strength of aluminum, no further significant improvements can be expected. Accordingly, high pressure ratio boost devices have been found in practice to have short life, to be associated with high maintenance cost, and thus have too high a product life cost for widespread acceptance.

Titanium, known for high strength and low weight, might at first seem to be a suitable next generation material. Large titanium compressor wheels have in fact long been used in aircraft jet engines that power aircraft from the B-52B/RB-52B to the F-22. However, titanium is one of the most difficult metals to work with, and currently the cost of production associated with titanium compressor wheels is so high as to limit wide-spread employment of titanium. It is also well known that titanium is highly reactive in the molten state, making it particularly difficult to cast titanium into thin molds without significant mold/metal reaction. This reaction layer must be removed at significant expense. Thin sections aggravate the problem of obtaining a sound casting free of this reaction layer.

The automotive industry is driven by economics. While there is a need for a high performance compressor wheel, it must be capable of being manufactured at reasonable cost. There are presently no known cost-effective manufacturing techniques for manufacturing automobile or truck industry scale titanium compressor wheels having the optimal design described above.

That is, while titanium compressor wheels per se are known, the methods by which they are manufactured are economically prohibitive. For example, it is known to manufacture titanium compressor wheels from solid titanium stock, using computer-aided manufacturing (CAM) equipment, also known as numerically-controlled cutting equipment. However, due to the difficulty of working with titanium, and due to the large amount of material which must be removed, this technique does not come into consideration as an economical means for production of titanium compressor wheels.

Casting techniques are also known, and can be classified into "rubber mold" techniques and "investment casting" techniques.

U.S. Pat. No. 6,019,927 (Galliger) entitled "Method of Casting a Complex Metal Part" teaches a method for casting a titanium gas turbine impeller which, though different in shape from a compressor wheel, does have a complex geometry with walls or blades defining undercut spaces. A flexible and resilient positive pattern is made, and the pattern is dipped into a ceramic molding media capable of drying and hardening. The pattern is removed from the media to form a ceramic layer on the flexible pattern, and the layer is coated with sand and air-dried to form a ceramic layer. The dipping, sanding and drying operations are repeated several times to form a multi-layer ceramic shell. The flexible wall pattern is removed from the shell, by partially collapsing with suction if necessary, to form a first ceramic shell mold with a negative cavity defining the part. A second ceramic shell mold is formed on the first shell mold to define the back of the part and a pour passage, and the combined shell molds are fired in a kiln. A high temperature casting material is poured into the shell molds, and after the casting material solidifies, the shell molds are removed by breaking.

It is apparent that the Galliger gas turbine flexible pattern is (a) collapsible and (b) is intended for manufacturing large-dimension gas turbine impellers for jet or turbojet engines. This technique is not suitable for mass-production of automobile scale compressor wheels with thin blades, using a non-collapsing pattern. Galliger does not teach a method which could be adapted to in the automotive industry.

"Investment casting", on the other hand, involves: (1) making a wax pattern of a hub with cantilevered airfoils, (2) casting a refractory mass about the wax pattern, (3) removing the wax by solvent or thermal means, to form a casting mold, (4) pouring and solidifying the casting, and (5) removing the mold materials.

There are however significant problems associated with the initial step of forming the compressor wheel wax pattern. Whenever a die (comprised of retractable die inserts) is used to cast the wax pattern, the casting die must be opened (die inserts retracted) to release the product. However, since the blades of a compressor wheel have a complex shape as discussed above, the complex geometry of the compressor wheel, with undercut recesses and/or back tapers created by the twist of the individual air foils with compound curves, not to mention dips and humps along the leading edge of the blade, impedes the withdrawal of the several parts of the die (die inserts).

It is know to side-step these problems by fashioning separate molds for each of the wax blades and for the wax hub. The individually formed wax blades and hub can then be assembled and fused to form a wax compressor wheel pattern. However, this creates a new set of problems. It is difficult to assemble a compressor pattern from separate wax parts with the required degree of precision—including coplanerism of airfoils, proper angle of attack or twist, and equal spacing. Further, stresses are encountered during assembling lead to distortion after removal from the assembly fixture. Finally, this is a labor intensive and thus expensive process. This technique cannot be employed on an industrial scale.

Certainly, titanium compressor wheels would seem desirable over aluminum or steel compressor wheels. Titanium is strong and light-weight, and thus lends itself to producing thin, light-weight compressor wheels which can be driven at high RPM without over-stress due to centrifugal forces.

There is thus a need for a simple and economical method for mass producing titanium compressor wheels, and for the low-cost titanium compressor wheels produced thereby. The method must be capable of reliably and reproducibly producing compressor wheels, without suffering from the prior art problems of dimensional or structural imperfections to which thin blades are particularly susceptible.

SUMMARY OF THE INVENTION

The present inventor investigated the problem of how to overcome the above-described technical problems in the manufacture of titanium compressor wheels in order to enable the economical manufacture of titanium compressor wheels. He was initially faced with a number of technical problems.

For example, each individual compressor wheel product must be manufactured with a very high degree of dimensional accuracy. Titanium compressor wheels must be capable of operating at high tip speeds necessary to produce high pressure ratio. Any slight distortion in air foil shape, length and curvature would compromise aerodynamic performance.

Further, errors in blade spacing would generate noise at these high operational speeds. Noise would annoy consumers, and thus noise suppression is an object of the present invention. It is known that aluminum compressor wheels made by casting from re-usable patterns (rubber patterns) often suffer imperfections due to the patterns being non-rigid, and compressor wheels produced thereby often suffer from noise. Thus, the process of the present invention should be capable of producing dimensionally very accurate blade geometries.

Most importantly, the present invention should provide a process with which titanium compressor wheels can be produced significantly more economically than with prior art processes.

The present inventor chose to attempt to develop a method for producing highly accurate positive patterns for use in the "lost wax" or investment casting technique for forming titanium compressor wheels. In view of the complex shape of a compressor wheel, with undercut recesses and/or back tapers created by the twist of the individual air foils with compound curves, not to mention dips and humps along the leading edge of the blade, it was the conventional wisdom at the time of the invention that it simply would not to be possible to create a "non-pullable" compressor wheel using a solid die.

Nevertheless, the present inventor decided to attempt an entirely novel approach in the manufacture of titanium compressor wheels: to first create a "non-pullable" titanium compressor wheel by a hybrid process involving (1) casting of a wax pattern, followed by (2) machining.

To those working in this art, the approach selected by the present inventor would appear counter-intuitive. That is, if the present invention is driven by economics, logic would dictate that fewer process steps are better than more process steps, and that a manufacturing technique involving both casting and machining would be more labor and equipment intensive than a single technique alone. Thus, those working in this are would not have even considered investigating a hybrid technique as envisioned by the present inventor.

Further yet, it could not be technically predicted that a product of a casting step would be sufficiently accurately dimensioned so as to be able to be simply machined by a "blind" tool in a fully automated process to produce a product free of distortion and defect. That is, a casting would have to be located so accurately in, e.g., numerically-controlled cutting equipment that a thin layer of material could be machined from each blade surface.

Further, the inventor had to overcome the problem of how to reliably cast titanium, a metal which is notoriously difficult to cast, particularly in a process of forming a final product having long thin blades.

And finally, even if a marriage of casting and machining could produce a compressor wheel which would be within tolerances required in automotive applications, there remained the important question of whether such a process could be designed to be more economical than the presently available techniques.

After extensive experimentation, the present inventor discovered that the objects of the invention could be achieved, and that a titanium compressor wheel having a non-pullable shape could be economically produced, using a hybrid process in which a positive compressor wheel pattern is first produced by an automated process in a die with solid retractable inserts, but differing from prior art in that the blades of the pattern are modified so as to have the desired shape only to the extent possible with pullable die inserts, i.e., with "undercut" or "backsweep" areas being "filled in", and only to the extent to prevent "back-lock" of the die inserts. This compressor wheel pattern is referred to as "pullable" since the die inserts can be extracted, leaving the cast wax shape. The cast wax pattern is referred herein to as "near net shape" since only the "undercut" or "backsweep" areas, which are filled in as discussed above, need to be machined in the subsequent machining step.

Contributing to the success of the invention is the fact that the filled-in areas contribute dimensional strength during the casting and removal of the wax pattern. Thus, the wax near net shape pattern, and consequently the machined net shape pattern, has a high degree of dimensional trueness as compared to a wax pattern wherein a net shape pattern with very thin blades is cast and pulled.

The near net shape pattern produced as described above could be machined to a "non-pullable" wax pattern shape prior to investment casting.

More preferably, the near net shape ("pullable") pattern is used in the near net shape form in investment casting, and the cast titanium product, having the near net shape, can be machined by conventional techniques to remove the material needed to complete the backsweep and undercut areas of the blades. In this preferred embodiment of the invention, wherein titanium is cast into a mold wherein the near net shape blades are thickened at the "filled in" blade areas, these thickenings coincidentally make the blade much easier to cast than in the case of thin compressor wheel blades. That is, the problems of mold/metal reaction, surface defects, inclusions, etc., for which titanium is notoriously famous, are to a large part overcome by initially casting the blades slightly thicker in accordance with the invention, followed by machining away the "filled in" areas. Accordingly, this embodiment results in a particularly successful casting technique.

Surprisingly, when carried out on an industrial scale, the cost and complexity of machining wax is approximately equal to the cost and complexity of machining titanium. Since the amount of material to be machined in the machining step is small compared to the known technique of, e.g., manufacturing titanium compressor wheels from solid titanium stock using computer-aided manufacturing (CAM) equipment, the process of the present invention is surprisingly economical.

Further yet, it is known that machining of titanium compressor wheels from stock titanium is expensive due to the amount of time required to machine away material and due to tool wear. In accordance with the present invention, since the amount of material being machined away is substantially less than in the case of machining from stock, the tool time and cost are negligible.

Thus, the process according to the present invention is surprisingly economical.

The foregoing has outlined rather broadly the more pertinent and important features of the present invention in order that the detailed description of the invention that follows may be better understood, and so that the present contribution to the art can be more fully appreciated. Additional features of the invention will be described hereinafter, which form the subject of the claims of the invention. It should be appreciated by those skilled in the art that the conception and the specific embodiments disclosed may be readily utilized as a basis for modifying or designing other compressor wheels for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the present invention reference should be made by the following detailed description taken in combination with the accompanying drawings in which.

DETAILED DESCRIPTION OF THE INVENTION

Figure 1:
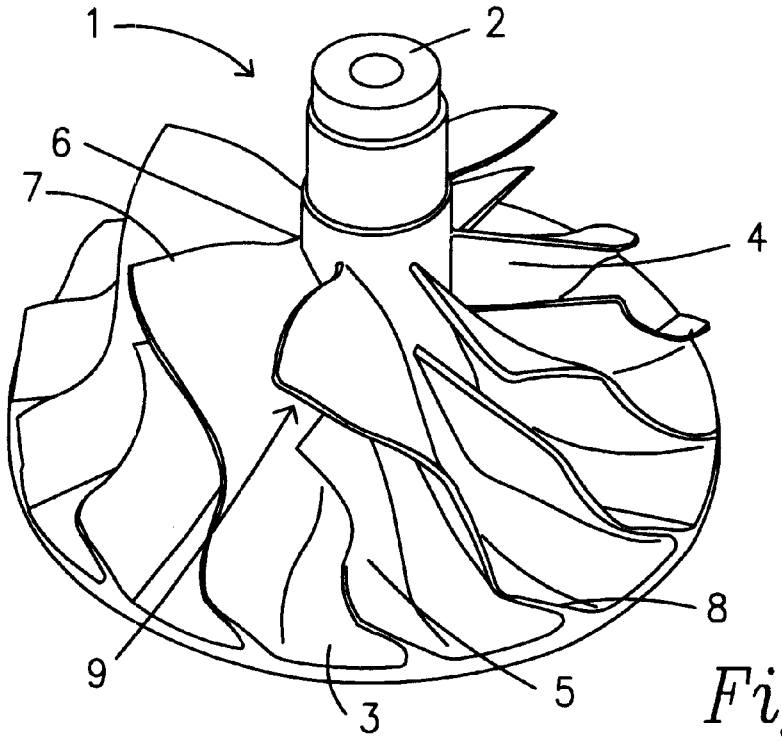
FIG. 1 shows a titanium compressor wheel (net shape) in elevated perspective view.

The present invention is primarily distinguished by the fact that the wax pattern used in the investment casting process is intentionally designed not to produce a final (net shape) compressor wheel, but rather, is designed to produce a near net shape pattern which must be subsequently machined or milled. Surprisingly, when forming a titanium compressor wheel using the hybrid or two-step process, the technical complexity of each step (pattern forming and machining) is substantially lower, distortion of the wax blades during pattern casting is reduced, casting itself is simplified, the process allows itself to be fully automated, and the dimensional accuracy of the final product is greater than with conventional techniques.

More importantly, the cost of producing the near net shape pattern in the first step is so low, that even when the cost of machining in the second step is added in, the final cost of manufacturing the cast titanium compressor wheel in accordance with the invention is lower than in the case of compressor wheels formed according to prior art techniques.

In a first embodiment of the invention, the hybrid method for economically producing a titanium compressor wheel having a non-pullable shape comprises:

(a) forming a pullable near net shape compressor wheel positive pattern in a die comprised of a plurality of die inserts;

(b) forming a mold around the positive pattern;

(c) removing the positive pattern;

(d) casting titanium into the mold;

(e) removing the mold to expose a titanium compressor wheel having a near net shape;

(f) machining said near net shape compressor wheel to the desired shape including machining undercut areas and optionally blade leading edges.

In an alternative embodiment of the invention, a titanium compressor wheel having a non-pullable shape is economically produced by a method comprising:

(a) forming a pullable near net shape compressor wheel positive pattern in a die comprised of a plurality of die inserts;

(b) machining the near net shape compressor wheel positive pattern to the desired positive pattern shape including machining undercut areas and optionally blade leading edges;

(c) forming a mold around the positive pattern;

(d) removing the positive pattern;

(e) casting titanium into the mold; and (f) removing the mold to expose a titanium compressor wheel having a non-pullable shape.

The present invention further contemplates finish machining the product of step (f) over part or all of it's surface, and/or chemically milling the product of step (b) or (f). That is, the wax pattern could be chemically milled with mild acetic acid, or the titanium shape could be chemically milled with hydrofluoric acid or other strong acid. The term "wax" as used herein includes wax/plastic materials, resins, and other sacrificial materials well known to those working in the investment casting art.

More specifically, according to the present invention, a titanium compressor wheel is easily and economically produced in an automated process using a solid (i.e., not flexible) die. A solid die is used to provide a high degree of dimensional accuracy to the wax pattern. In accordance with the invention, "undercut" or "backswept" areas of the compressor wheel blades, or areas of twist, which would have produced a "back-lock"—preventing extraction of the die inserts—are filled in, but only to the extent necessary to make the die inserts pullable. The term "back-lock" is conventional in the art as evidenced by U.S. Pat. No. 4,139,046 (Stanciu) "Turbine Wheel Pattern and Method of Making Same".

The resulting pattern is "pullable" since the die inserts can be extracted, but it does not produce the desired final or net compressor wheel shape, since filled in areas need to be removed by machining. The pattern is also referred to as "near net shape", since only the "undercut" or "backsweep" areas need to be machined away in the subsequent machining step. Accordingly, the amount of material which must be removed by machining is minimal compared to machining a compressor wheel from a solid block, and tool time and tool wear is negligible.

The near net shape pattern, commonly formed of wax, can either be machined to form a "non-pullable" pattern prior to investment casting, or preferably, the near net shape ("pullable") pattern can be used as is in investment casting, and the cast titanium product, having the near net shape, can be machined by conventional techniques to remove the material needed to complete the backsweep and undercut areas of the blades.

It was also surprisingly discovered that, when carried out on an industrial scale, the cost and complexity of machining wax is approximately equal to the cost and complexity of machining titanium. Since the amount of material to be machined in the machining step is small compared to the known technique of, e.g., manufacturing titanium compressor wheels from solid titanium stock using computer-aided manufacturing (CAM) equipment, the process of the present invention is surprisingly economical.

The invention thus provides for the first time a process by which non-pullable titanium compressor wheels can be mass produced by a simple, low cost, economical process. In the following, the invention will be described using simple die inserts, i.e., one die insert per air passage, although it will be readily apparent that compound die inserts, i.e., two or more die inserts per air passage, could also be used. Since the complexity of automation is increased as the number of dies per air space increases, the die is preferably a "single pull" die wherein all inserts are extracted from the pattern at once. A "two pull" die wherein more than one die insert is provided in each air passage, and wherein die extraction takes place in two steps, is still economical. If more than two "pull" steps are required to extract the dies, the complexity and cost of the die tends to become prohibitive. Accordingly, with presently known pattern forming techniques, "one pull" and "two pull" dies are preferred.

The term "titanium compressor wheel" is used herein to refer to a compressor wheel comprised predominantly of titanium, and includes titanium alloys such as 6 Al 4 V Titanium. This alloy is readily cast, is weld-repairable, is widely available, low cost, and has excellent strength. It is an incidental benefit of this alloy that it has a stiffness and density comparable to aluminum, with blade natural frequencies nearly identical to those of aluminum. Aluminum is the material with which those working in the art have the greatest amount of familiarity, and blade geometry developed using aluminum can be translated directly to 6 Al 4 V Titanium.

The process of the present invention will now be described in greater detail on the basis of the figures.

FIG. 1 shows an example of a "non-pullable" compressor wheel 1, comprising an annular hub 2 which extends radially outward at the base part to form a base 3. The transition from hub to base may be curved (fluted) or may be angled. A series of evenly spaced thin-walled full blades 4 and "splitter" blades 5 are form an integral part of the compressor wheel. Splitter blades differ from full blades mainly in that their leading edge begins further axially downstream as compared to the full blades.

Figure 2:
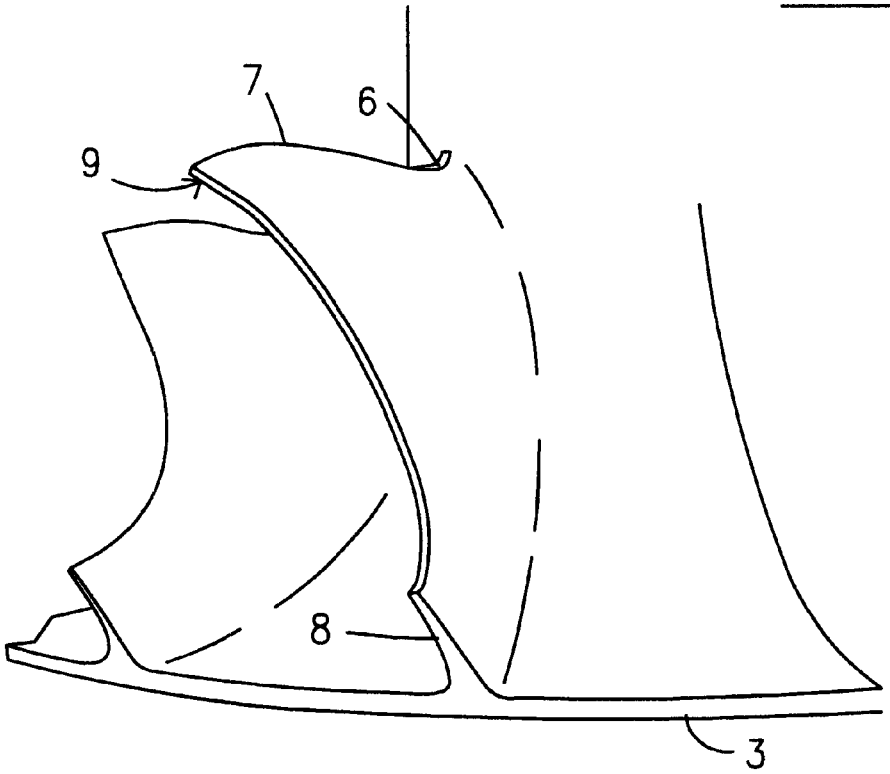
FIG. 2 shows an enlarged partial section of the compressor wheel of FIG. 1 in elevated perspective view.

The complex shape of the blades is dictated by the aerodynamics involved in the efficient centrifugal "pumping" of air. In use, the compressor wheel is located in a compressor housing, with the blades passing close to the inner wall of the compressor housing. As air is drawn into the compressor inlet, it passes through the air channels of the rapidly rotating compressor wheel, and is thrown (centrifugally) outwards along the base of the compressor wheel into an annular volute chamber, and this compressed air is then conveyed to, e.g., the engine intake. It is readily apparent that the complex geometry of the compressor wheel, with dips 6 and humps 7 along the blade leading edge, undercut recesses 9 created by the twist of the individual air foils with compound curves, and rake or back tapers (back sweep) 8 at the blade trailing edge, would make it impossible to cast such a shape in one piece in an automatic process using a non-elastic die, since the blade geometry would impede the withdrawal of die inserts or mold members. FIG. 2 shows an enlarged partial section of the compressor wheel of FIG. 1 in elevated perspective view.

It will be apparent from the above explanation and the figures that the "back-lock" problem addressed by the present invention is more of a three-dimensional problem than a two-dimensional problem. Since it is not easy to illustrate a three dimensional back-lock on paper, and for purposes of explanation only, FIG. 4 shows an exaggerated two-dimensional representation of the curvature of the blades of a net shape compressor wheel along section line 4—4 of FIG. 3. It will be readily apparent that a non-elastic die insert located in the passages between the blades 4,5 can not be extracted.

In accordance with the present invention, a near net shape pattern is made by modifying the blade shape shown in FIG. 4 only to the extent necessary to be able to "pull" die inserts from between the blades. Pulling may be radially or along a curve or arc.

Figure 4:
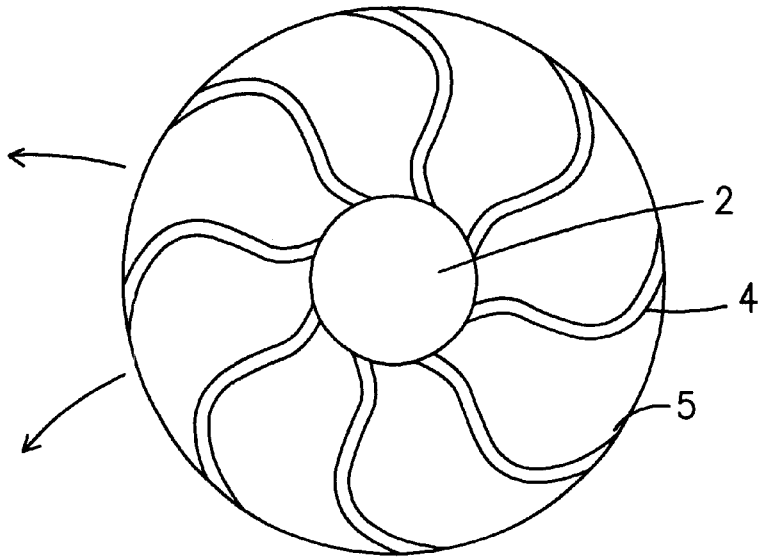
FIG. 4 is an exaggerated representation of the curvature of the blades of a net shape compressor wheel along line 4—4 indicated in FIG. 3.
Figure 5:
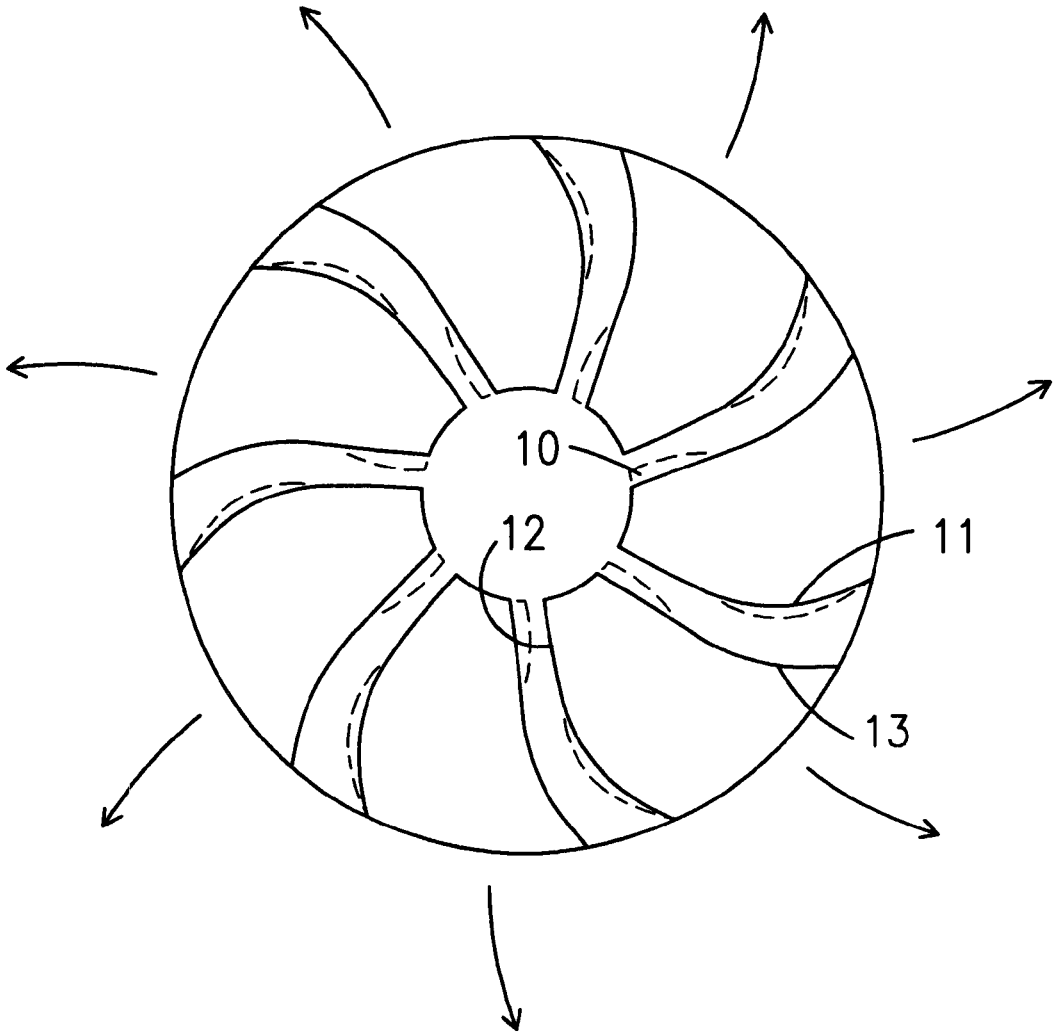
FIG. 5 is an exaggerated representation of the curvature of the blades of a near net shape compressor wheel otherwise comparable to FIG. 4.

The result of the modification of the (exaggerated) pattern is shown in FIG. 5. There is shown an exaggerated representation of the curvature of the blades of a near net shape compressor wheel otherwise comparable to FIG. 4. Undercut or backsweep areas 10, 11 which would prevent die insert extraction are filled in only to the extent necessary to make the die pullable. Minimum filler material is used in the near net shape pattern in order to minimize the amount of material which must later be removed by machining. Those blade surfaces which do not impede die extraction 12, 13 are defined directly by the die inserts.

Figure 3:
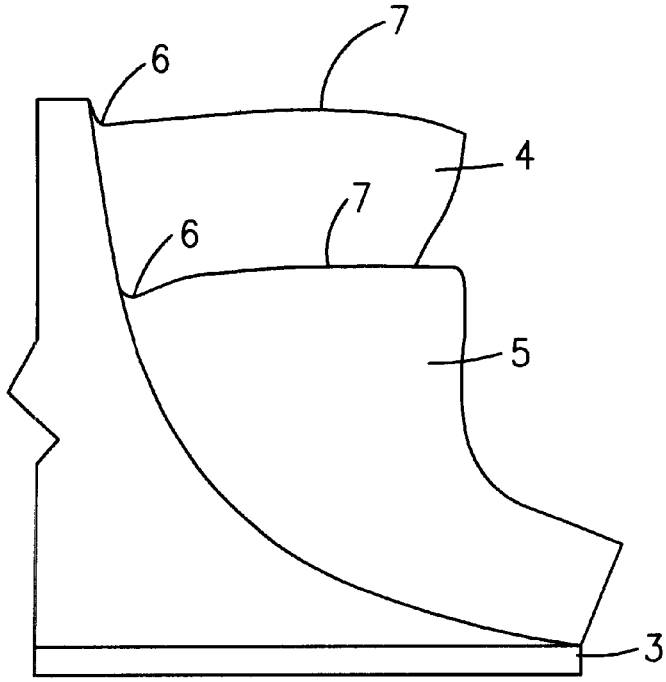
FIG. 3 shows the compressor wheel of FIG. 1 in side profile view.
Figure 6:
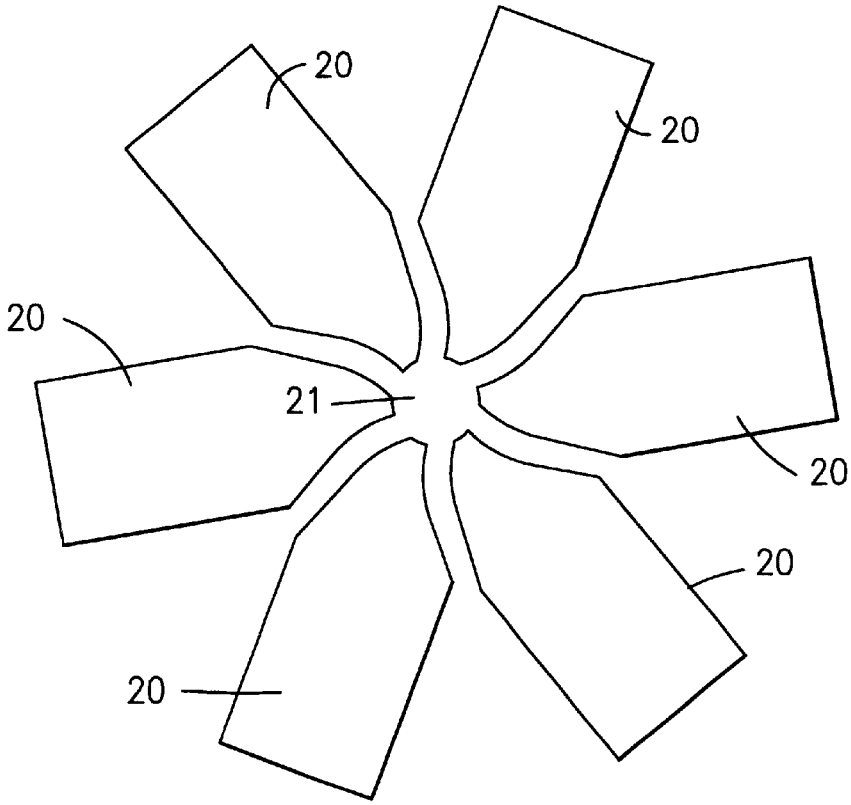
FIG. 6 shows a simplified section of a die and near net shape pattern, sectioned perpendicular to the rotation axis of the compressor wheel, with die inserts defining the hub and blades of a compressor wheel.

FIG. 6 shows a simplified section of a die defining a near net shape pattern 21 corresponding to FIG. 3, sectioned perpendicular to the rotation axis of the compressor wheel, with die inserts 20 defining the hub and blades of a near net shape compressor wheel pattern, including filler material 10, 11 to be removed by machining. The tool or die for forming the wax form is shown in closed condition, in sectional view along section line 4 shown in FIG. 3, and simplified (omitting mechanical extraction means, etc.) for better understanding of the essential feature of the invention, revealing a cross section through a compressor wheel shaped mold. The mold defines a hub cavity and a number of inserts 20 that occupy the air passages between the blades, thus defining the blades, the walls of the hub, and the floor of the air passage at the base of the hub. With these inserts in place as shown in FIG. 6, molten wax or other sacrificial material (hereafter simply referred to as wax) is poured into the die. The wax is allowed to cool and the individual inserts 20 are automatically extracted radially as shown in FIG. 7 or along some simple or compound curve in order to expose the solid wax pattern 21 and make possible the removal of the pattern from the die.

Figure 7:
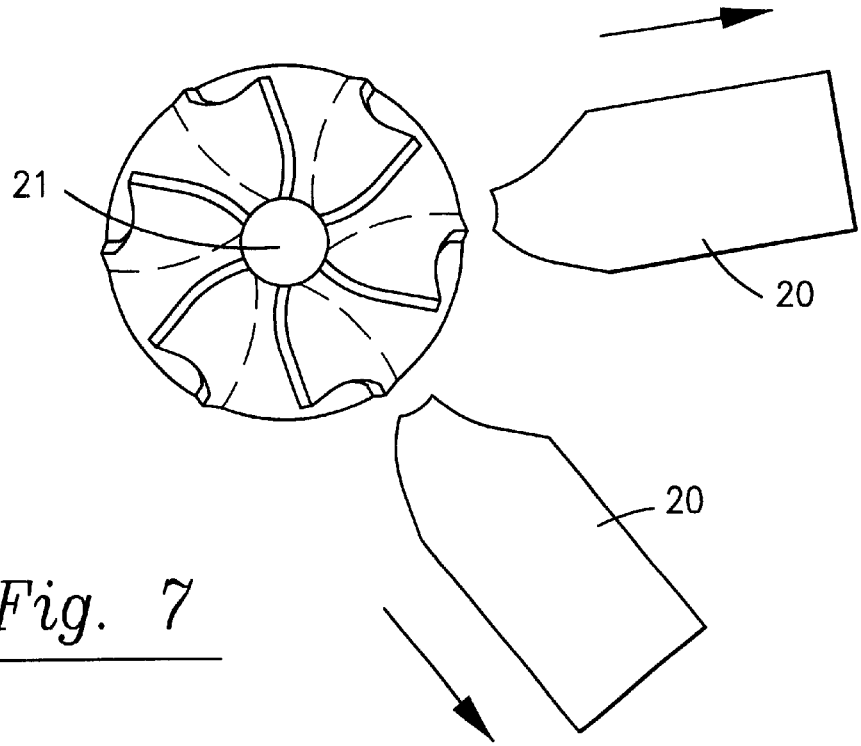
FIG. 7 corresponds to FIG. 6 and shows a top view onto a compressor wheel sectioned perpendicular to the rotation axis at about the center of the hub.

FIGS. 6 and 7 show 6 dies and 6 blades for ease of illustration; however, the die preferably has a total of either 12 (simple) or 24 (compound) inserts for making a total of 6 full length and 6 "splitter" blades. In the case of 24 compound inserts, one set of 12 corresponding inserts is first extracted simultaneously, and then the second set of 12 corresponding inserts is extracted simultaneously. Compound die inserts can be produced by dividing the air cavity into two sections, and either die insert can be extracted radially or along a curve, depending upon blade design.

The wax casting process according to the invention is designed so that it can operate fully automatically. The inserts are assembled to form a mold, wax is injected, and the inserts are timed by a mechanism to retract in unison.

Once the near net shape wax pattern satisfying the above requirements has been produced, the wax pattern can be machined to produce the net shape pattern (preferably including a pour funnel as conventional in the casting art), which is then used in investment casting in the conventional manner. Alternatively, the near net shape wax pattern is used in investment casting in the conventional manner, and the resulting near net shape cast titanium compressor wheel is machined to remove the "filler" material.

The casting technique itself can be traditional investment casting, with modifications as known in the art for casting titanium. The near net shape or net shape (machined) wax pattern is dipped in a ceramic slurry, removed from the slurry and coated with sand or vermiculite to form a ceramic layer on the wax pattern. This layer is dried, and the dipping, sanding and drying operations are repeated several times to create a multi-layer ceramic shell mold enclosing or encapsulating the wax pattern. After a drying process the shell is "de-waxed" and hardened by firing. The next step involves filling the mold with molten titanium. Molten titanium is very reactive and requires a special ceramic shell material with no available oxygen. Pours are also preferably done in a hard vacuum. Some foundries use centrifugal casting to fill the mold. Most use gravity pouring with complex gating to achieve sound castings. After cool-down, the shell is broken and removed, and the casting is given special processing to remove the mold-metal reaction layer, usually by chemical milling. The product is a lightweight, precise geometry compressor wheel capable of withstanding high RPM and high temperatures.

The method for manufacturing the titanium compressor wheel according to the present invention lends itself to being produced in a simplified, highly automated process. As a result, the compressor wheel is not liable to any deformities as might result when using an elastic deformable mold, or when assembling separate blades onto a hub, according to the procedures of the prior art.

Tested against an aluminum and titanium compressor wheels of similar design, the titanium compressor wheels of the present invention showed no signs of fatigue even when run through thirteen or more times the number of operating cycles which caused failure in aluminum compressor wheels.

The procedure for machining the near net shape pattern or wheel to the net shape is well known and need not be described herein in detail. Machining may be over all or part of the blade surface. Patents teaching the use of computer-aided manufacturing (CAM) equipment, also known as numerically-controlled cutting equipment, include U.S. Pat. No. 5,193,314 (Wormley, et al) entitled "Computer controlled grinding machine for producing objects with complex shapes". Wormley et al teaches a grinding machine particularly adapted to produce blades and buckets of the kind used in turbines and other objects having complex curved surfaces. Data blocks representing the surface of the object to be created are stored in a computer that controls the machine to finish a rough blank into the final object. An abrasive belt passes over a nose roller to make a line contact with the workpiece. The belt and the workpiece are subject to six computer-controlled degrees of freedom: three in translation and three in rotation. The supporting arm of the nose roller can be moved angularly about the belt contact point while the nose roller can be adjusted about a perpendicular axis through the contact point of the belt. Feedback controls indicate the position of and the motion velocity about the six axes. A positional feedback indicates the precise position of the workpiece at the finishing point to permit automatic compensation for belt wear.

U.S. Pat. No. 5,587,912 (Andersson, et al.) entitled "Computer aided processing of three-dimensional object and apparatus therefore" teaches a method of manufacturing a three-dimensional body using a program with computer aided design, comprises the steps of generating input data for a computer, the data representing a three-dimensional body model, storing the input data in the computer, instructing the program via an input device to activate first signals for generating based on the input data, a plurality of surfaces representing a three-dimensional body model, each surface comprising a contour of a vertical section extending through a central axis of the three-dimensional body model, instructing the program via the input device to activate second signals for modifying contours of vertical sections in accordance with the desired three-dimensional body, and instructing the program via the input device to activate third signals for storing output data which denotes modifications of the contours in response to second signals, with the output data being transmittable from the computer for manufacturing the three-dimensional body.

Additional patents teaching three to five axis machining include the following, the disclosures of which are incorporated herein by reference: U.S. Pat. Nos. 5,396,160 (Chen); 5,453,933 (Wright et al); 5,552,995 (Sebastian); 5,787,753 (Dougherty); 5,997,578 (Hoermansdoerfer); 6,146,245 (Hoermansdoerfer); 6,335,503 (Tsung); and 6,363,298 (Shin et al).

The wax pattern or the cast shape can be chemically milled. Chemical milling of titanium is well known as described in U.S. Pat. No. 4,900,398, and need not be described herein in detail.

Although an economical method for manufacture of a cast titanium compressor wheel has been described herein with great detail with respect to an embodiment suitable for the automobile or truck industry, it will be readily apparent that the compressor wheel and the process for production thereof are suitable for use in a number of other applications, such as piston airplanes and fuel cell powered vehicles. Although this invention has been described in its preferred form with a certain particularity with respect to an automotive internal combustion compressor wheel, it is understood that the present disclosure of the preferred form has been made only by way of example and that numerous changes in the details of structures and the composition of the combination may be resorted to without departing from the spirit and scope of the invention.

Now that the invention has been described,

I claim:

1. A method for manufacturing a titanium compressor wheel (1) having a non-pullable shape, said method comprising:

(a) forming a pullable near net shape compressor wheel positive pattern in a die comprised of a plurality of non-elastic die inserts (20);

(b) casting a titanium compressor wheel including blades from said near net shape pattern to form a near net shape casting; and (c) machining the blades of said near net shape casting to a non-pullable net shape titanium compressor wheel.

2. A method for manufacturing a titanium compressor wheel having a non-pullable shape (1), said method comprising:

(a) forming a pullable near net shape compressor wheel positive pattern in a die comprised of a plurality of die inserts (20), said near net shape differing from said non-pullable shape (1) in that areas preventing pulling of said die inserts are filled in (10, 11) as necessary to make said shape pullable;

(b) forming a mold around said positive pattern;

(c) removing said positive pattern;

(d) casting titanium into said mold;

(e) removing said mold to expose a titanium compressor wheel having a pullable shape; and (f) machining said near net shape compressor wheel positive pattern to the desired positive pattern shape including machining away said filled in areas (10, 11).

3. A method as in claim 2, wherein air passages are defined between said blades (4), and wherein said die comprises one to three die inserts (20) per air passage.

4. A method as in claim 3, wherein in step (b) said die inserts are extracted simultaneously.

5. A method as in claim 3, wherein in step (b) said die inserts are extracted in two steps.

6. A method as in claim 2, wherein air passages are defined between said blades, and wherein said die comprises one die insert (20) per air passage.

7. A method as in claim 2, wherein air passages are defined between said blades, and wherein said die comprises two die inserts (20) per air passage.

8. A method as in claim 2, wherein said compressor wheel blades comprise alternating full blades (4) and splitter blades (5).

9. A method as in claim 2, wherein said machining is by numerically-controlled cutting equipment.

10. A method as in claim 2, wherein said machining is selected from the group consisting of three axis milling to five axis milling, turning, abrasion, and electrical discharge machining.

11. A method as in claim 2, wherein said titanium compressor wheel is comprised of a 6 Al 4 V titanium.

12. A method for manufacturing a titanium compressor wheel having a non-pullable shape, said method comprising:

(a) forming a pullable near net shape compressor wheel positive pattern in a die comprised of a plurality of die inserts, said near net shape differing from said non-pullable shape in that areas preventing pulling of said die inserts are filled in as necessary to make said shape pullable;

(b) machining said near net shape compressor wheel positive pattern to a desired positive pattern shape including machining away said filled in areas;

(c) forming a mold around said positive pattern;

(d) removing said positive pattern;

(e) casting titanium into said mold; and (f) removing said mold to expose a titanium compressor wheel having a non-pullable shape.

13. A method as in claim 12, wherein air passages are defined between said blades, and wherein said die comprises one to three die inserts (20) per air passage.

14. A method as in claim 13, wherein in step (b) said die inserts are extracted simultaneously.

15. A method as in claim 13, wherein in step (b) said die inserts are extracted in two steps.

16. A method as in claim 12, wherein said compressor wheel blades comprise alternating full blades (4) and splitter blades (5).

17. A method as in claim 12, wherein said machining is by numerically-controlled cutting equipment.

* * * * *